United States Patent [19]

Braunhut

[11] Patent Number: 4,497,069

[45] Date of Patent: Feb. 5, 1985

[54] UNIVERSALLY FITTING, MODULAR BALLISTIC GARMENT

[76] Inventor: Harold N. Braunhut, 200 Fifth Avenue, New York, N.Y. 10010

[21] Appl. No.: 459,369

[22] Filed: Jan. 20, 1983

[51] Int. Cl.[3] ..... F41H 1/02

[52] U.S. Cl. ..... 2/2.5; 2/326; 2/DIG. 6

[58] Field of Search ..... 2/2.5, DIG. 6, 326

[56] References Cited

U.S. PATENT DOCUMENTS

| | | | |
|---|---|---|---|
| 1,385,371 | 7/1921 | Fraser | 2/2.5 |
| 3,409,907 | 11/1968 | Barratt | 2/2.5 |
| 3,452,362 | 7/1969 | Korolick et al. | 2/2.5 |
| 3,559,210 | 2/1971 | Hansen | 2/2.5 |
| 3,783,449 | 1/1974 | Davis | 2/2.5 |
| 3,803,639 | 4/1974 | Cohen | 2/2.5 |
| 3,884,403 | 5/1975 | Brewer | 2/DIG. 6 |
| 3,901,579 | 8/1975 | Demerest | 2/326 X |
| 3,973,275 | 8/1976 | Blauer | 2/2.5 |
| 4,096,977 | 6/1978 | Barville et al. | 2/DIG. 6 |
| 4,287,607 | 9/1981 | Leach | 2/2.5 |

*Primary Examiner*—Louis K. Rimrodt

*Attorney, Agent, or Firm*—Goodman & Teitelbaum

[57] ABSTRACT

A universally fitting modular ballistic garment having a harness member to which are connected various body protector members. A chest protector is formed of ballistic material and is removably secured onto the harness member by Valcro-type fasteners. Additional Velcro-type fasteners are provided both on the chest protector and the harness so that additional body protector members can be connected, as desired. The additional body protector members can include a back protector, a crotch protector and a trauma plate. Additionally shoulder pads and side panel pads can also be mounted onto the harness. In a modified form, the chest and back protector can be joined together by shoulder and side straps provided with Velcro-type fasteners.

13 Claims, 7 Drawing Figures

UNIVERSALLY FITTING, MODULAR BALLISTIC GARMENT

BACKGROUND OF THE INVENTION

This invention relates to ballistic garments, and more particularly to a universally fitting, modular bullet-proof garment for fitting onto a person's torso.

Ballistic garments, better known as bullet-proof garments, are becoming more prevelantly utilized by law enforcement individuals, and others, as a result of the increased crime rate and increased utilization of guns. Many of the presently available bullet-proof garments are complete body protectors including sections fitting over most parts of the wearer's body, especially the torso. However, because of the extensive amount of coverage provided by these garments, they are heavy in weight and quite costly.

Other bullet-proof garments approach the opposite extreme and only provide for vest protection. While these garments are substantially lighter than the entire torso protectors, they accordingly provide for less protection.

Occasionally, a law officer needs minimal protection during regular use, but may require extra protection for high risk assignments. At other times, the law officer may be put on special assignment and for this special assignment may require the additional protection. In these, and various other types of situations requiring extra protection, it was heretofore required to get one garment for the minimal protection needs, and a separate garment for the greater protection needs.

Another problem with the prior art bullet-proof protectors is that the garment must normally be fitted to the particular wearer. As a result, the size of the bullet-proof garment would vary in accordance with the user's body measurements, and a garment could not normally be passed from one individual to another individual since it would not properly fit the other individual, and therefore may not sufficiently cover vital portions of the wearer's body.

Accordingly, there is a need for a ballistic garment which can have modular sections that can be added on to a basic garment to thereby provide as much body coverage as is required. This will permit the garment to be utilized for minimal protection, and also provide interfitting sections which can be added on to the garment to cover other parts of the body thereby providing additional coverage as is needed. There is also a need for a ballistic garment which can provide a universal fit to accommodate different body sizes. In this manner, a single garment can be utilized for different sized individuals and, accordingly, the garment can be easily manufactured and can be easily transferred from one person to another person while still providing an adequate fit.

SUMMARY OF THE INVENTION

It is therefore an object of the present invention to provide for a bullet-proof garment that avoids the aforementioned problems of prior art devices.

Another object of the present invention is to provide a ballistic garment having interfitting sections which can be added on to the garment, as needed, to build up the garment from a basic chest protector to a torso protector.

Yet another object of the present invention is to provide a ballistic garment having a plurality of sections, each of which can be added on to garment, as desired, to protect an additional portion of the wearer's body.

Still another object of the present invention is to provide a ballistic garment which includes individual sections that can be incorporated within or interfitted to the garment, as needed, the sections including a chect protector, a back protector, and a crotch protector, as well as side and shoulder protectors.

An additional object of the present invention is to provide a ballistic garment which can accommodate different size measurements of different body sizes.

Still a further object of the present invention is to provide a ballistic garment having a plurality of body sections which can be added on to a basic harness, as needed.

Briefly, there is provided a universally fitting, modular ballistic garment which includes a harness having a belt portion and shoulder strap portions, and which can fit onto body torsos of various sizes. A chest protector formed of flexible ballistic material is provided and can be removably secured to the harness, whereby the chest protector is suitably positioned onto the wearer's body by means of the harness. Additional coupling arrangements are provided for removably securing additional body protector members to either the chest protector or the harness, whereby these additional body protector members can be suitably positioned with respect to the wearer's body.

The additional body protector members, which can be interfitted on in a modular fashion, include a back protector which can be secured onto the check protector to depend therefrom, as well as shoulder pads which can slidably be secured onto the shoulder strap portions, and side panels which can slidably fit onto the belt portion. Furthermore, trauma plates can be secured onto both or either the front or back protector for additional localized protection.

In order to secure, or interconnect the various body protecting sections to the harness as well as to each other, hook-in-pile fasteners such as Velcro fasteners are utilized. In this manner, the sections can be assembled by the user and the number of sections used and the amount of protection required can be provided by easily assembling the protector members.

In an embodiment of the present invention, there is provided a chest protector and a back protector. Shoulder straps span between the upper edges of the chest and back protectors and fit over the shoulders. Side straps are provided for connection between the side edges of the chest and back protectors. The shoulder and side straps are of substantially the same size. The hook-in-pile fasteners are utilized for interconnecting the straps to the chest and back protectors. Additional hook-in-pile fasteners are provided to interconnect other body protector members thereon, where for example, a crotch protector can depend from the chest protector, and trauma plates can be added onto either or both the front and back protectors. The side panels can be slidably positioned on the side straps, and shoulder pads can be slidably positioned on the side straps, and shoulder pads can be slidably positioned on the shoulder straps.

The various body protector sections are formed of flexible ballistic material of a type well known in the art. The trauma plates can be formed of ballistic steel and secured within a pocket formed of ballistic material.

BRIEF DESCRIPTION OF THE DRAWINGS

With the above and other additional objects and advantages in view, as will hereinafter appear, this invention comprises the devices, combinations, and arrangements of parts hereinafter described by way of example, and illustrated in the accompanying drawings of a preferred embodiment in which.

In the various figures of the drawings, like reference characters designate like parts.

DESCRIPTION OF THE PREFERRED EMBODIMENTS

Figure 1:
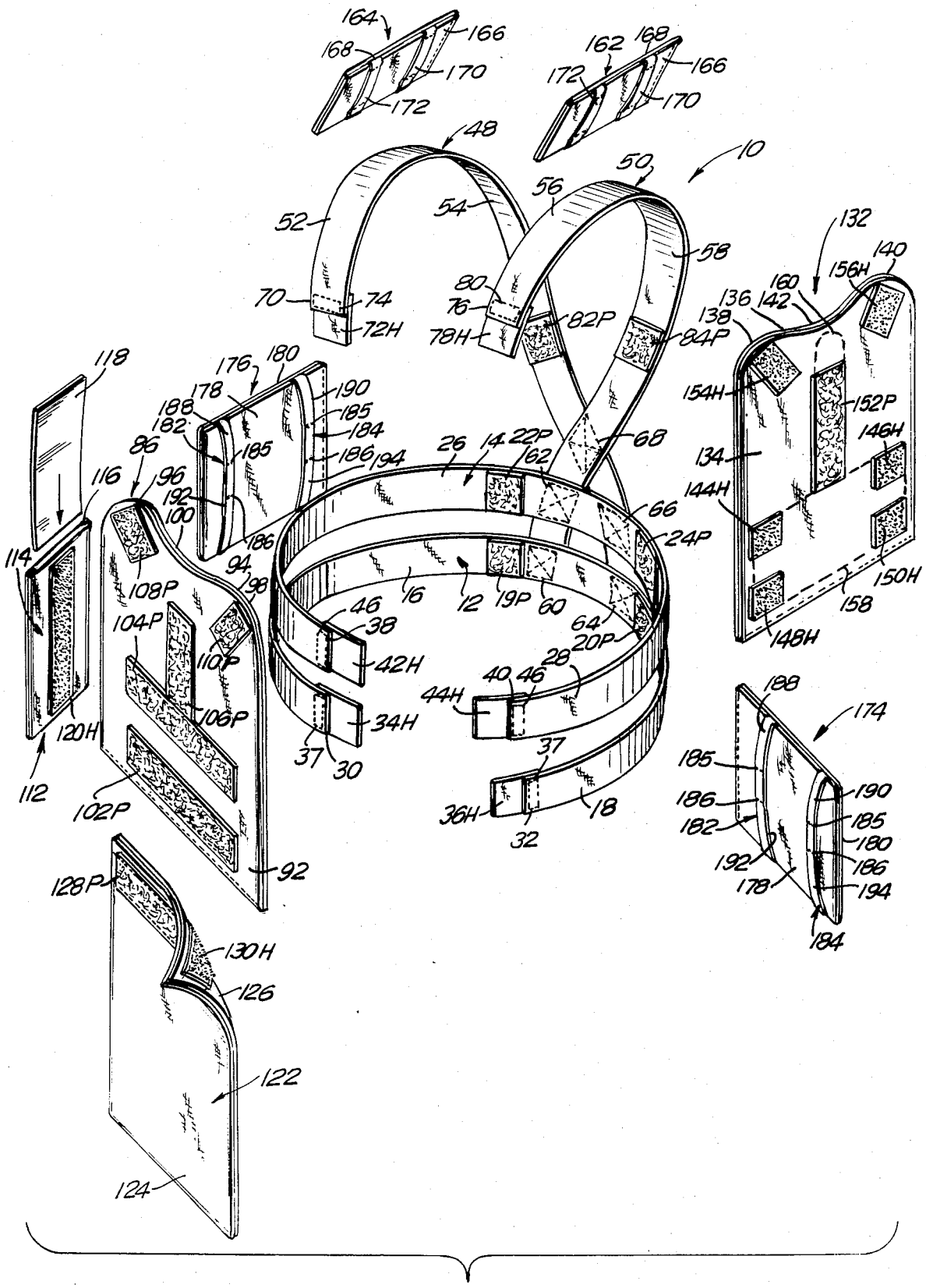
FIG. 1 is an exploded perspective view of the various parts of the universally fitting, modular ballistic garment, in accordance with the present invention.

Referring now to the FIG. 1, there is shown a universally fitting, modular ballistic garment, including a harness, shown generally at 10, to which other parts of the garment are connected. The harness 10 comprises two spaced apart body encircling belts including a lower body encircling belt 12 spaced apart from an upper body encircling belt 14.

The belt 12 includes an inner surface 16 and an outer surface 18. Placed on the inner surface of the lower belt 12 adjacent to the back portion thereof are strips 19P, 20P providing the pile members of the fasteners. The pile members which include loop-like elements, can typically be one part of a Velcro fastener. Corresponding pile member strips 22P, 24P are provided on the inner surface 26 of the belt 14. The belt 14 includes an outer surface 28.

Belt 12 terminates in opposing ends 30, 32. Connected to these respective ends 30 and 32 are tabs 34H and 36H, each of which contains multiple hook-like elements to provide the hook member of the fastener on its inner facing surface. The hook members can typically be the other part of the Velcro fastener. The tabs 34H, 36H can be secured by means of the stitching 37 to the ends 30, 32 of the belt 12.

Similarly, the belt 14 terminates in opposing ends 38, 40 to which are connected the respective tabs 42H, 44H. On the inner facing surfaces of the tabs 42H, 44H are also hook members of the fasteners. The tabs 42H, 44H can be connected by means of the stitching 46 to the ends 38, 40 of the belt 14.

A pair of shoulder straps 48, 50 are provided. Shoulder strap 48 includes an outer surface 52 and an inner surface 54. Likewise, shoulder strap 50 includes an outer surface 56 and an inner surface 58.

The two shoulder straps 48, 50 are connected in a criss-crossing fashion at the back of the garment. Shoulder strap 50 has its inner surface 58 connected respectively to the spaced apart belts 12 and 14 by means of the stitching 60 and 62. Similarly, the inner surface 54 of shoulder strap 48 is connected to the spaced apart belts 12 and 14 by means of the stitching 64, 66. The two shoulder straps are also interconnected by stitching 68 at the crossing, which joins the inner surface 54 of the shoulder strap 48 to the outer surface 56 of the shoulder strap 50.

The shoulder strap 48 terminates at its distal end 70 in a tab 72H having a hook member of the fastener on its inner surface. Tab 72H can be connected by means of the stitching 74.

At the distal end 76 of shoulder strap 50, there is also connected a tab 78H by means of the stretching 80. A hook member of the fastener is also provided on the inner surface of the tab 78H.

An additional strip 82P of the pile member of the fastener is provided on the inner surface 54 of shoulder strap 48, adjacent the back portion thereof and spaced from the interconnecting stitching 68. A corresponding strip 84P of the pile member of the fastener is provided on the inner surface 58 of shoulder strap 50 at approximately the same positioning of the pile member strip 82P.

The harness member 10 has its strap sections formed of elastic material in order to accommodate different measurements of body sizes. In this manner, the shoulder straps 48, 50 can stretch to fit over shoulders of various sizes. Likewise, the body straps 12, 14 can stretch so as to fit around torsos of varying sizes.

Figure 6:
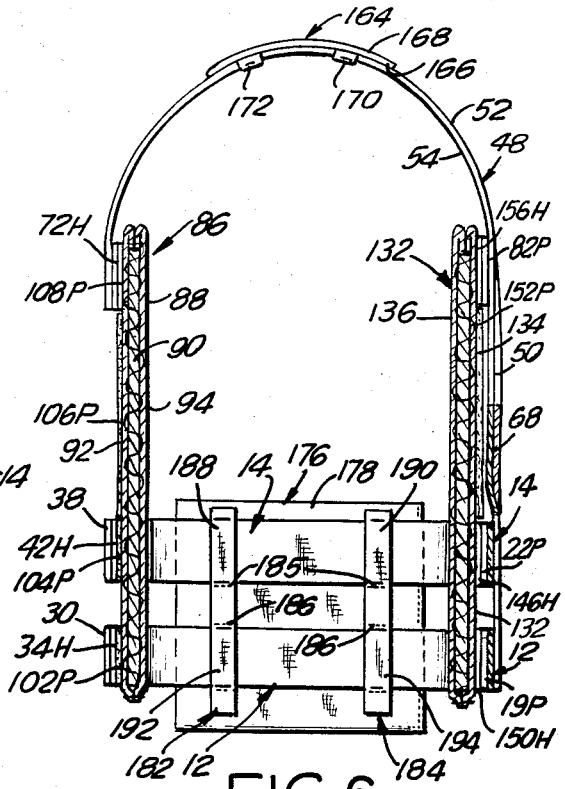
FIG. 6 is a cross sectional side view, showing the garment having most of the sections thereon, including a chest protector, a back protector, a shoulder pad, and a side panel.

There is also provided a chest protector 86 formed of flexible ballistic material. Typically, as shown in FIG. 6, the chest protector, as well as all of the other protectors, includes an outer shell of nylon ballistic material 88 enclosing a number of layers of ballistic material 90. One type of nylon material is available from DePont Company under the trademark Kevlar. The numbers of layers and the type of internal ballistic material used depends upon the amount of protection required. In accordance with well known ballistic standards, various layers are included to provide sufficient stoppage for different caliber weapons. In the present protectors, the number of internal layers can be selected as desired in order to provide a particular sufficient thickness.

The chest protector 86 includes a front side 92, and a rear side 94. The protector 86 has a substantially rectangular shape with the upper corner end curved at 96, 98, and includes therebetween a recessed neck portion 100 for comfort. On the front side 92 of the chest protector 86, there are provided two elongated horizontal pile member strips 102P, 104P spaced apart from each other at the lower section of the chest protector 86. Upwardly extending and perpendicular to the 104P is provided a vertical elongated pile member strip 106P. Adjacent the upper corners ends 96, 98, there are provided angularly positions pile member strips 108P, 110P.

Figure 2:
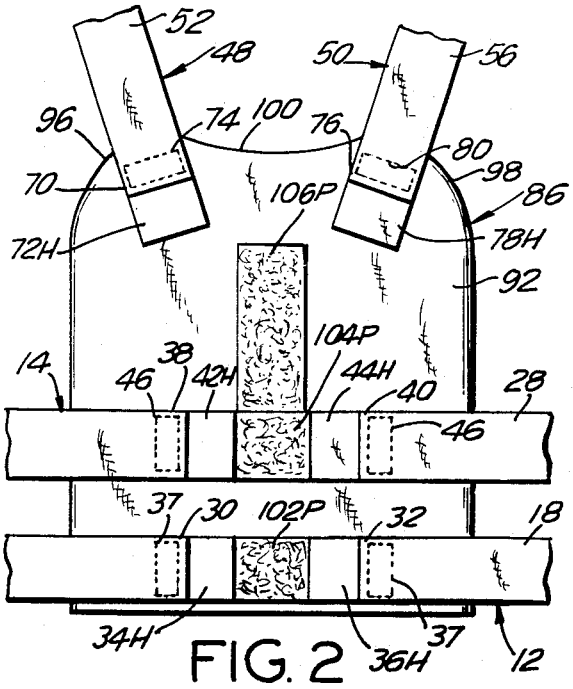
FIG. 2 is a front view of the garment, showing the chest protector interconnected to the harness.

The chest protector 86 is secured to the harness by means of the hook-in-pile fasteners, as is shown in FIG. 2. specifically, the hook member tabs 72H, 78H of the respective straps 48, 50 are secured onto the pile member strips 108P, 110P on the front side 92 of the chest protector 86 to securely hold the shoulder straps 48, 50 on the upper part of the chest protector 86. The hook member tabs 42H, 44H at the distal end of the upper belt 14 are then secured onto the horizontal pile member strip 104P provided on the chest protector. The extent to which the tabs 42H, 44H overlap onto the strip 104P will depend upon the measurement size of the body about which the belt 14 is encircling. The hook member tabs 34H, 36H of the lower belt 12 will similarly be fastened onto the pile member strip 102P.

For ease of placement, the shoulder straps of the harness can first be connected to the chest protector in the manner set forth above. Then, the harness and connected chest protector can be placed on the wearer's body, whereby the harness will automatically hold the chest protector in place against the wearer's body while the belt straps are brought around the wearer's torso and attached to the chest protector in the manner set forth above.

Because of the elasticity of the harness members, as well as the capability of the belt to appropriately extend onto the horizontal strips 102P, 104P, the garment when assembled as shown in FIG. 2 will suitably fit onto varied body sizes, where the chest protector will be property positioned to protect the front organs of the wearer's body.

As shown in FIG. 1, there can be also provided a trauma plate, shown generally at 112. The trauma plate includes a flexible ballistic material 114 folded on itself to provide a pocket therein with a pocket opening 116 at its upper end in which can be inserted a piece of ballistic steel material 118. For convenience, the ballistic steel material 118 is slightly curved in its longitudinal director to accommodate a normal body curvature. On an outer rear surface of the material 114, there is provided a vertical elongated strip 120H defining a hook member of one Velcro fastener.

Figure 3:
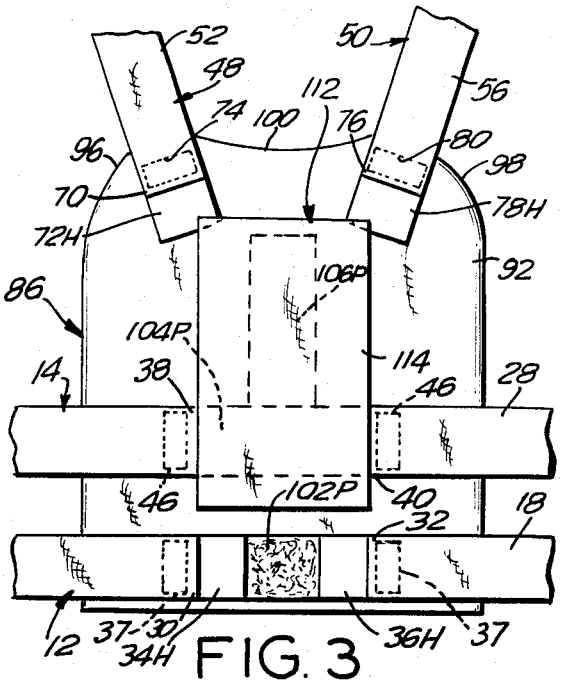
FIG. 3 is a front view similar to that shown in FIG. 2, showing a trauma plate disposed onto the chest protector.

As shown in FIG. 3, after the chest protector 86 has been properly positioned on the wearer's body using the harness, the trauma plate 112 can be added by securing the hook member fastener strip 120H onto the pile member strip 104P. This will secure the trauma plate 112 in place onto the chest protector 86, and will provide additional protection of the vital organs such as the heart, ribs, etc. However, the main purpose of the trauma plate is to reduce, if not eliminate, the impact effect of a bullet as it hits the section of the chest protector.

There is also provided a crotch protector 122, as shown in FIG. 1. The crotch protector 122 is formed as a substantially rectangular section of flexible ballistic material of the type heretofore described. The crotch protector includes a front side 124 and a rear side 126. Connected along the upper edge portion of the front side 124 is an elongated pile member strip 128P. A corresponding elongated hook member strip 130H is connected across the upper edge portion of the rear side 126.

Figure 4:
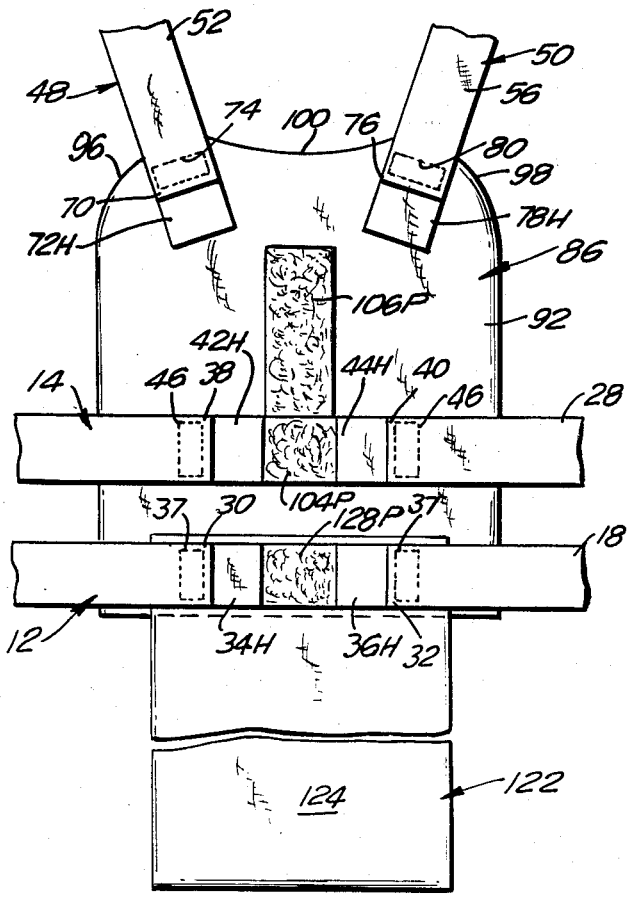
FIG. 4 is a front view similar to that of FIG. 2, showing a crotch protector depending from the chest protector.

As shown in FIG. 4, the crotch protector 122 is attached with the hook member strip 130H connecting onto the elongated pile member strip 102P on the front side 92 of the chest protector 86. This connection is made before closing the lower belt 12. Accordingly, first the crotch protector 122 is made dependant from the chest protector 86, and then the hook member tabs 34H, 36H of the lower belt 12 are connected directly onto the opposing, now exposed, pile member strip 128P on the front side 124 of the crotch protector 122.

There is also provided a back protector, shown generally at 132 in FIG. 1. The back protector 132 is also formed of flexible ballistic material of the type heretofore described and includes a rear side 134 and a forward side 136. The back protector 132 is shaped substantially similar to that of the chest protector 86, being substantially rectangular in shape with the upper corner edges curved at 138, 140, and having its upper edge therebetween arcuately recessed in a downward direction at 142 to accommodate the wearer's neck.

Connected onto the outwardly directed rear side 134 are four hook member strips 144H, 146H, 148H, 150H disposed on a lower rectangular portion thereof. A vertically elongated pile member strip 152P is provided above this lower rectangular portion. Adjacent the curved corner edges 138, 140, there are provided hook member strips 154H, 156H disposed at an angle thereto similar to pile member strips 108P, 110P.

Although the back protector 132 can be formed of sufficient ballistic material to provide the protection needed, there are vital organs near the back portion of the wearer's body torso that occasionally require additional protection in localized regions. Accordingly, additional layers of ballistic material can be sewn into the rectangular section defined by the broken line 158, as well as within a vertical section defined by the broken line 160, in order to protect such vital organs as the spleen, kidney, spinal cord, etc.

Figure 5:
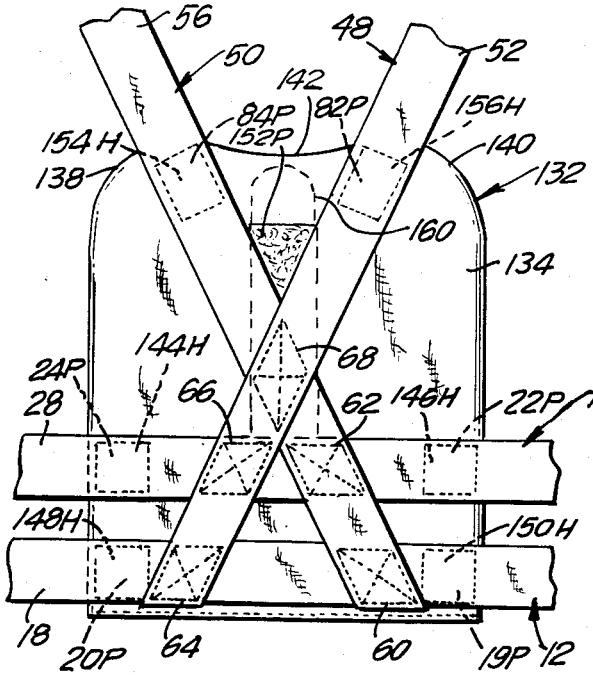
FIG. 5 is a rear view of the garment, showing the connection of a back protector to the harness.

As shown in FIG. 5, the back protector 132 is connected to the back portion of the harness 10. Specifically, the pile member tabs 22P, 24P, which are positioned on the inner surface 26 of the back of the upper belt 14 are matingly adhered onto the upper hook member strips 144H, 146H on the rear side 134 of the back protector 132. Similarly, the two pile member tabs 19P, 20P on the inner surface 16 of the back of the lower belt 12 are secured onto the mating pile member strips 148H, 150H of the back protector 132. This secures the belts 12, 14 onto the back protector 132.

Likewise, the shoulder strips 48, 50 are secured onto the back protector 132 by adhering the pile member strip 84P on the inner surface 58 of the strap 50 onto the mating hook member strip 154H on the back protector 132, and by adhering the pile member strip 82P on the inner surface 54 of the shoulder strap 48 onto the mating hook member strip 156H on the back protector 132. Typically, the back protector 132 will first be secured to the harness 10, and then the harness will be placed on the wearer's body with the additional sections of the chest protector, the crotch protector, etc. connected thereafter, in the manner set forth above.

Should a trauma plate be desired to be placed on the back protector 132, a trauma plate similar to that shown at 112 can be adhered by the hook member strip 120H onto the elongated pile member strip 152P of the back protector 132. The trauma plate will then fit between the back protector 132 and the shoulder straps 48, 50 for additional support thereof.

There can also be provided additional protection by means of shoulder pads 162, 164, shown in FIG. 1. Each of the shoulder pads 162, 164, is formed of a flexible ballistic material, heretofore described, in the form of a rectangular configuration. The shoulder pads 162, 164 each includes a rear side 166 and a front side 168. A pair of ties 170, 172 straddle across the width of the rear side 166 to define loops therebeneath for receiving a respective one of the shoulder straps 48, 50 therethrough. In this way, the shoulder pads 162, 164 can be suitably slid onto the shoulder straps 48, 50 and positioned therealong, as desired, in order to provide additional protection to the top portion of the shoulders, as shown in FIG. 6.

Side panels 174, 176 can also be provided for additional protection. The side panels 174, 176 are likewise formed of a flexible ballistic material of the type heretofore described, and are shaped as proximate squares. Each of the side panels 174, 176 includes a rear side 178 and a front side 180. Ties 182, 184 are spaced apart and straddle across the front surface 178. The ties 182, 184 are connected with stitches 185, 186, in order to define an upper pair of loops 188, 190 and a lower pair of loops 192, 194, for respectively receiving the upper belt 14 and the lower belt 12. Each of the side panels 174, 176 can be slid onto side portion of the belts 12, 14 by passing the belts through the appropriate loops of the side panels, and thereby slidingly fitting the side panels in place, as shown in FIG. 6.

It is accordingly appreciated, that the ballistic garment heretofore described is one that can be built up in modular fashion to provide the protection as desired. Specifically, it can be provided as a simple garment with only a chest protector mounted on a harness, as shown in FIG. 2. If desired, a trauma plate can be mounted onto the chest protector as shown in FIG. 3, and additionally, a crotch protector can be added as shown in FIG. 4. Should protection be required in the rear, a back protector as shown in FIG. 5 can also be added. Furthermore, shoulder pads and side panels can also be added as shown in FIG. 6.

With all of the sections added, the garment provides a substantial covering for almost the entire torso of the wearer. The number of sections utilized would depend upon the wearer's needs and requirements. Furthermore, a trauma plate can also be added onto the back protector, and additional layers of material can also be provided therein to make the protectors as thick as needed in order to provide for the necessary protection for a particular caliber shot.

Figure 7:
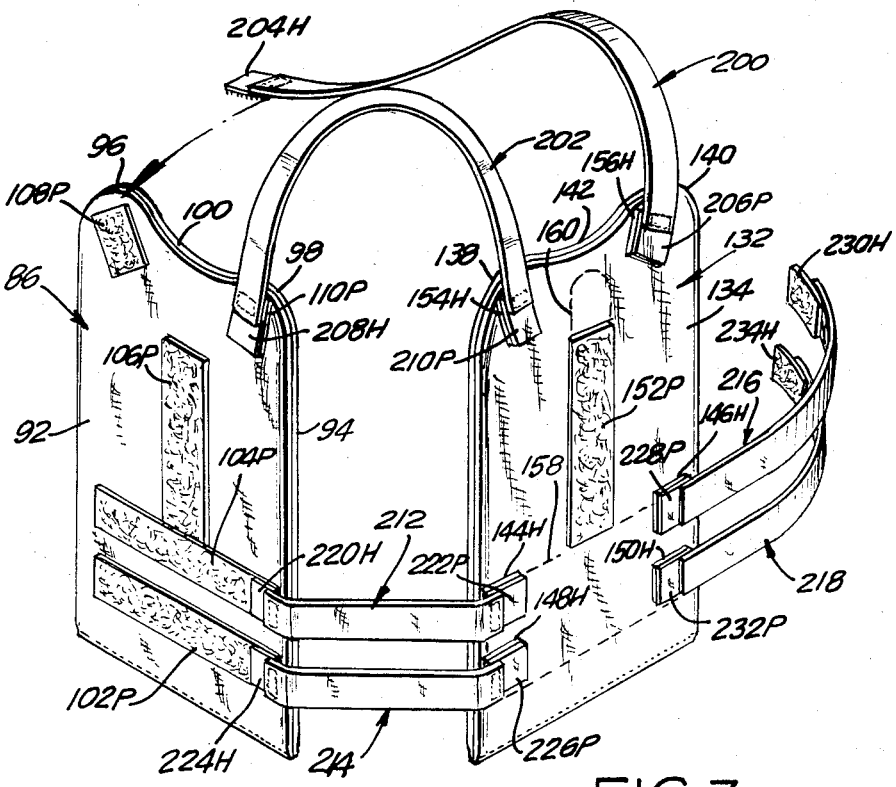
FIG. 7 is a perspective view of another embodiment of the ballistic garment, showing chest and back protectors interconnected by shoulder straps and side straps.

Referring now to FIG. 7, there is shown an alternate embodiment of the ballistic garment. Specifically, as shown in FIG. 7, there is provided the same chest protector 86 of the type heretofore described, the same back protector 132 also of the type heretofore described. However, instead of providing a harness 10 as shown in FIG. 1, there are provided shoulder straps and side straps for interconnecting the chest and back protectors.

More particularly, a pair of similar shoulder straps 200, 202 are provided. As the distal ends of the shoulder strap 200 there are provided a hook member tab 204H and an opposing pile member tab 206P facing in the same direction. Corresponding hook member tab 208H and opposing pile member tab 110P are provided at the distal ends of the strap 202.

The shoulder strap tabs 204H, 206P would matingly engage the pile member strip 108P on the chest protector 86 and the hook member strip 156H on the back protector 132. Similarly, the shoulder strap tabs 208H and 210P respectively engage the mating pile member strip 110P on the chest protector 86 and the hook member strip 154H on the back protector 132.

A pair of similar side straps 212, 214 are provided on one side, and another similar pair of similar side straps 216, 218 are provided on the opposing side. The side strap 212 includes a hook member tab 220H and a pile member tab 222P at its opposing distal ends. A corresponding hook member tab 224H and pile member tab 226P are connected at the opposing distal ends of the side strap 214.

The side strap tab 220H engages the pile member strip 104P located on the chest protector 86, and the side strap tab 222P engages the hook member strip 144H on the back protector 132. Likewise, the side strap tab 224H engages the pile member strip 102P on the chest protector 86, and the side strap tab 226P engages the hook member strip 148H on the back protector 132. In this manner, the chest and back protectors are interconnected at one side.

The opposing side of the chest and back protector are likewise interconnected by means of a pile member tab 228P and a hook member tab 230H at the distal ends of the side strap 216 correspondingly engaging the hook member strip 146H on the back protector 132 and the pile member strip 104P on the chest protector 86. Another pile member tab 232P and hook member tab 234H are provided at the distal ends of the side strap 218. These correspondingly engage the hook member strip 150H on the back protector 132 and the pile member strip 102P on the chest protector 86.

All of the shoulder straps and side straps can be made substantially the same size, so that they are all interchangeable. Also, they are formed of elastic material so that the garment will be able to fit onto varied body sizes.

It should be appreciated, that in the embodiment of FIG. 7, additional sections of body protector members could also be added. For example, the crotch protector member 122 of FIG. 1 could be depended from the chest protector 86 of FIG. 6. Trauma plates 112 of the type heretofore described, could also be added onto the chest protector 86 or back protector 132. Similarly, shoulder pads 162, 164 and side panels 174, 176 can also be added for additional protection.

Accordingly, in the embodiment of FIG. 7, there can also be built up a body garment from a simple garment having chest and back protectors to one that has substantially the entire torso protection.

There has been disclosed heretofore the best embodiments of the invention presently contemplated. However, it is to be understood that various changes and modifications may be made thereto without departing from the spirit of the present invention.

What is claimed is:

1. A universally fitting, modular ballistic garment comprising:

a chest protector fabricated from flexible ballistic material;

harness means for fitting said chest protector onto body torsos of varied sizes, said harness means including at least one side belt and a pair of shoulder straps;

first securing means for removably securing said side belt and shoulder straps to said chest protector so that said chest protector can be suitably positioned on a wearer's body;

said first securing means including first Velcro-type fasteners provided on inwardly facing surfaces at ends of said side belt and at ends of said shoulder straps, and mating second upper and lower Velcro-type fasteners provided on outwardly facing surfaces of said chest protector for receiving in engagement thereon, respectively, said first Velcro-type fasteners of said shoulder straps and said side belt;

plate means to reduce an impact effect of a bullet as the bullet hits a central section of said chest protector;

said plate means including a pouch fabricated from flexible ballistic material, and a trauma plate of ballistic steel material secured within said pouch, said pouch having a smaller surface than outer surface area of said chest protector;

second securing means removably securing said pouch to a central portion of said outer surface area of said chest protector in a position to protect particular parts of the wearer's body; and said second securing means including a third Velcro-type fastener provided on an inwardly facing surface of said pouch, and a mating fourth Velcro-type fastener provided on an outwardly facing surface of said central portion of said chest protector;

said fourth Velcro-type fastener being disposed between said second upper and lower Velcro-type fasteners, and said fourth Velcro-type fastener being disposed perpendicular to said second lower Velcro-type fastener which receives said first Velcro-type fasteners of said side belt so that said pouch can be properly positioned to protect said particular parts of the wearer's body when fitted onto body torsos of varied sizes.

2. A ballistic garment as in claim 1, wherein said shoulder straps are permanently connected to said side belt.

3. A ballistic garment as in claim 2, wherein a pair of spaced apart body encircling side belts are provided, and said pair of shoulder straps cross at a back portion of the harness means, each shoulder strap being coupled to a back part of both body encircling side belts.

4. A ballistic garment as in claim 1, and comprising a crotch protector fabricated from flexible ballistic material, additional securing means removably securing said crotch protector to depend from said chest protestor.

5. A ballistic garment as in claim 1, comprising side panels fabricated from flexible ballistic material, ties straddling said side panels to define loops for slidably receiving therethrough said side belt portion, so that said side panels can be conveniently positioned along said side belt.

6. A ballistic garment as in claim 1, wherein said side belt and said shoulder straps are fabricated from elastic material to stretchably accommodate different torso sizes.

7. A ballistic garment as in claim 1, and comprising shoulder pads fabricated from flexible ballistic material, ties straddling said shoulder pads to define loops for slidably receiving therethrough a respective one of said shoulder straps so that a respective one of said shoulder pads can be conveniently positioned along each of said shoulder straps.

8. A ballistic garment as in claim 1, wherein said mating second lower Velcro-type fastener on said chest protector includes an elongated strip in order to suitably position said first Velcro-type fasteners on said ends of said side belt onto said elongated strip to accommodate varied body sizes.

9. A ballistic garment as in claim 1, and further comprising a back protector fabricated from flexible ballistic material, additional securing means removably securing said back protector to said harness means so that said back protector can be suitably positioned on the wearer's body.

10. A ballistic garment as in claim 9, wherein said back protector includes additional localized layers of ballistic material secured within said back protector to thereby protect particular parts of the wearer's body.

11. A ballistic garment as in claim 9, wherein said side belt includes two side straps, said additional securing means including fifth Velcro-type fasteners provided on inwardly facing surfaces at opposite ends of said two side straps and at opposite ends of said shoulder straps, and mating sixth upper and lower Velcro-type fasteners provided on outwardly facing surfaces of said back protector for receiving in engagement thereon, respectively, said fifth Velcro-type fasteners of said shoulder straps and said side straps so that opposing ends of said shoulder and side straps are secured to said chest and back protectors, respectively.

12. A ballistic garment as in claim 11, wherein said shoulder straps and side straps are of elastic material to stretchably accommodate different body sizes.

13. A ballistic garment as in claim 11, wherein said shoulder straps and side straps are all of substantially equal length.

* * * * *